US006219877B1

(12) United States Patent
Lowrey et al.

(10) Patent No.: US 6,219,877 B1
(45) Date of Patent: Apr. 24, 2001

(54) PIVOTAL AND PIVOTAL ADJUSTABLE DUAL ROLLER PAINT FRAMES

(76) Inventors: Roland E. Lowrey, 1475 Grove Ave., Upland, CA (US) 91786; James M. Guest, 5 Wilderness Pl., Phillips Ranch, CA (US) 91766

( * ) Notice: Subject to any disclaimer, the term of this patent is extended or adjusted under 35 U.S.C. 154(b) by 0 days.

(21) Appl. No.: 09/267,508

(22) Filed: Mar. 12, 1999

Related U.S. Application Data

(60) Provisional application No. 60/077,796, filed on Mar. 12, 1998.

(51) Int. Cl.[7] ..... B05C 17/02

(52) U.S. Cl. ..... 15/230.11; 492/13

(58) Field of Search ..... 15/230, 230.11; 492/13, 19; D4/119, 122

(56) References Cited

U.S. PATENT DOCUMENTS

| | | | | |
|---|---|---|---|---|
| 2,035,127 | * | 3/1936 | Hinton . | |
| 2,824,328 | * | 2/1958 | Bedford | 15/230.11 |
| 3,130,435 | * | 4/1964 | Smith | 15/230.11 |
| 3,340,131 | * | 9/1967 | Leibow | 15/230.11 |
| 4,000,537 | * | 1/1977 | Woo | 15/230.11 |
| 5,249,330 | * | 10/1993 | Janssen | 15/230.11 |
| 5,715,562 | | 2/1998 | Lowrey et al. | 15/230.11 |
| 6,000,090 | * | 12/1999 | Sutherland | 15/230.11 |
| 6,012,865 | * | 1/2000 | Scott | 15/230.11 |

FOREIGN PATENT DOCUMENTS

| | | | | |
|---|---|---|---|---|
| 1579501 | * | 7/1969 | (FR) | 15/230.11 |

* cited by examiner

*Primary Examiner*—Terrence R. Till
(74) *Attorney, Agent, or Firm*—Christie, Parker Hale, LLP

(57) ABSTRACT

A roller paint frame with a pivotal frictionally held connection mating the frame handle and shaft to a "U" shaped frame whose ends are parallel to each other and hold paint roller covers. The pivotal mechanism is comprised of a threaded stud sufficient in length to pass through holes centered in the flattened end of the shaft that is attached to the frame handle and the flattened center of the "U" shaped frame, a nylon washer set atop the stud between these mating portions and another nylon and metal washer set atop the protruding threaded end of the stud all secured by a lock nut. The lock nut is tightened sufficient to establish a tension on the assembled components to hold the frame handle and shaft and the "U" shaped frame at any angle of choice. The angle may be changed through the application of pressure applied to the frame handle. The nylon washers enhance pivoting and prevent clogging or lock-up of the pivotal mechanism. Three of the four configurations of this art device have two pieces that form the said "U" shaped frame thereby allowing the user to adjust the ends closer together or farther apart.

18 Claims, 4 Drawing Sheets

PIVOTAL AND PIVOTAL ADJUSTABLE DUAL ROLLER PAINT FRAMES

CROSS-REFERENCE TO RELATED APPLICATIONS

This application claims priority to provisional application No. 60/077,796, filed Mar. 12, 1998.

FIELD OF THE INVENTION

This application pertains to an angularly adjustable Paint roller frame for the application of paint or other liquid coating materials to small four sided or round surfaces such as wrought iron or wood style type fences, poles or beams, patio stringers or similar type objects.

BACKGROUND OF THE INVENTION

Commercially available paint roller frames are either of a standard non-adjustable single roller type device or of a spring handle dual roller end type device. The major limitation of these prior art devices is that they cannot be pivoted or adjusted in a way that permits easy application of the liquid material to two sides of a multi-sided item to be protected or decorated, such as, wrought iron or wood style fencing, poles, beams and small metal or thin wood frame pieces. The user's hand oftentimes comes in contact with the next closest item such as a post or wood style, especially if these items are spaced closely together. Additionally, the spring handle dual roller end must be squeezed by hand to close sufficiently enough around the item to be protected or decorated so as to apply the liquid material to the item. After a few brief minutes, the hand becomes tired of squeezing the spring type handle.

The only other alternative to using these prior art devices is to use a small paint brush or some form of paint sprayer. The major limitation of the paint brush is that it leaves brush streaks and it takes too long to apply the material to the item to be protected, especially if the item is of any significant width and length. The primary limitation to using a paint spraying device is that too much paint is wasted and the coverage of the material tends to be uneven.

SUMMARY OF THE INVENTION

The present invention provides for easy angular or angular and pivotal adjustment of the frame handle and shaft portion to the paint roller covers installed on the ends of the mating "U" shaped frame portion. Application of the liquid material can be made to two sides, at the same time of the item being protected or decorated. Because of the pivotal ability of the invention, rubbing of the paint frame handle or the user's hand against the next closest post, style or frame piece is effectively eliminated.

Another feature of the invention is that it can be pivoted during the material application process by applying pressure to the frame handle and shaft while the dual rollers are in contact with the surface being protected or decorated. The built-in tension of the pivot mechanism maintains any desired angle selected by the user.

It is, therefore, a principal object of the present invention to provide the user with a pivotal or a pivotal adjustable dual roller paint frame which eliminates the disadvantages of the prior art devices.

Other objects of this invention are as follows:

To provide a dual roller paint frame device that can be pivoted easily and continually, if necessary, as the user applies the liquid coating material.

To provide a paint roller device capable of painting two sides of an object at the same time.

To provide a paint roller device that is versatile and which can be used to apply paint and other liquid coatings to wrought iron or wood styles, posts, fence frame pieces, patio stringers, beams and various size poles.

To provide an adjustable paint roller device which is simple in design and construction, can be readily and easily manufactured and assembled, and sold at a price that is competitive with existing art devices.

In the case of three of the embodiments, to provide an adjustable paint roller frame whose "U" shaped frame portion can be adjusted in width to accommodate painting or decorating items of varying widths.

For a fuller understanding of the nature and objects of this invention, reference is made to the following detailed description taken in connection with the accompanying drawings.

DETAILED DESCRIPTION OF THE INVENTION

Figure 1A:
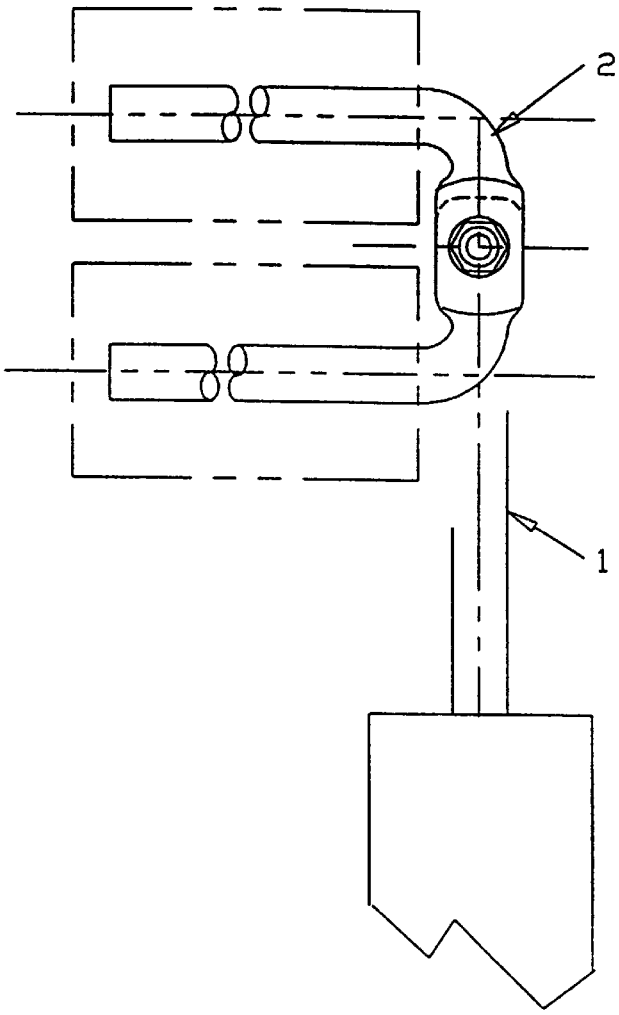
FIG. 1A is a front view of a paint frame according to a first preferred embodiment of the invention.

Referring now to the drawings, FIG. 1A depicts a front view of a paint frame according to a preferred embodiment of the invention. The paint frame includes a frame handle and shaft 1, a "U" shaped frame portion 2, a threaded stud 3, nylon washers 4 and 5, a steel washer 6 and a lock nut 7. The paint frame includes a pivotal mechanism located where the flattened end of the paint frame handle and shaft portion 1, the flattened shaft end having a hole through the center, intersects with the flattened center of the "U" shaped frame portion 2 which has a hole through the center. Roller covers are installed over the parallel ends of this latter portion for the application of protective or decorative coating to two opposite sides of an item at the same time, such as, a wrought iron post, pole, wood style or other similar type pieces.

Figure 1B:
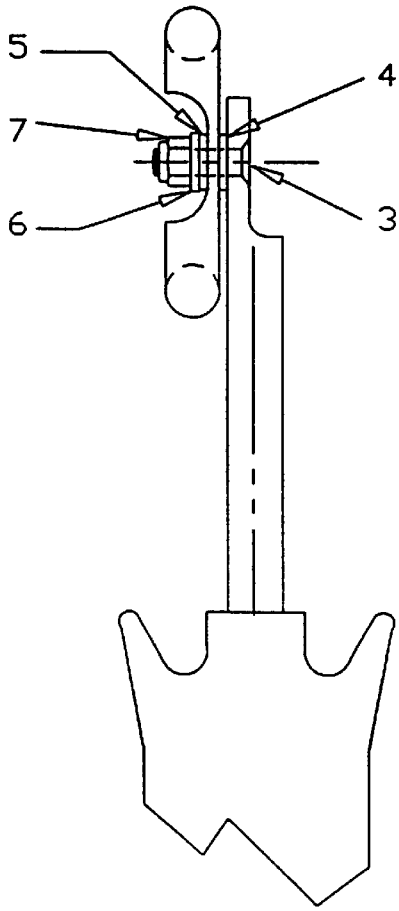
FIG. 1B depicts a side view of the paint frame shown in FIG. 1A.

Referring now to FIG. 1B, the frame handle and shaft 1 and "U" shaped frame portion 2 shown in FIG. 1A are mated together by a threaded stud 3 that is pressed into the flattened end of the frame handle and shaft portion 1, washers 4, 5, and 6 used to separate and allow movement of the pieces, then a lock nut 7 installed over the remaining threaded end of the stud securing all pieces firmly together.

As shown in FIGS. 1A and 1B, the pivot mechanism includes a threaded stud 3 that is installed through a hole centered in the flattened end of the frame handle and shaft portion 1. A nylon washer 4 is inserted over the protruding stud 3 and the "U" shaped frame portion 2, with a hole in the flattened center section, is placed over the protruding threaded end of the stud 3 on top of the nylon washer 4. Another nylon washer 5 and then a steel washer 6 are then placed over the protruding end of the stud 3. Lock nut 7 is installed over the remaining protruding end of the stud 3. Lock nut 7 not only secures the components forming the pivotal mechanism, it also applies and secures the friction tension on both frame portions 1 and 2. The surface finish of the flattened areas of the two frame portions 1 and 2 and the use of the nylon washers 4 and 5 allows the "U" shaped frame portion 2 to be smoothly adjusted to any desired angle either by hand through applying pressure on the "U" shaped frame portion 2 or by applying pressure to the frame handle with shaft 1 against the "U" shaped frame portion 2 while the device is in use.

This embodiment, while being capable of pivoting in either direction, is not adjustable like the three alternative embodiments depicted in FIGS. 2A and 2B, 3A and 3B, and 4A and 4B, as the parallel ends of the "U" shaped frame portion 2 that hold the roller covers, are fixed at a given distance from each other depending on the manufactured size and length of this portion.

Figure 2A:
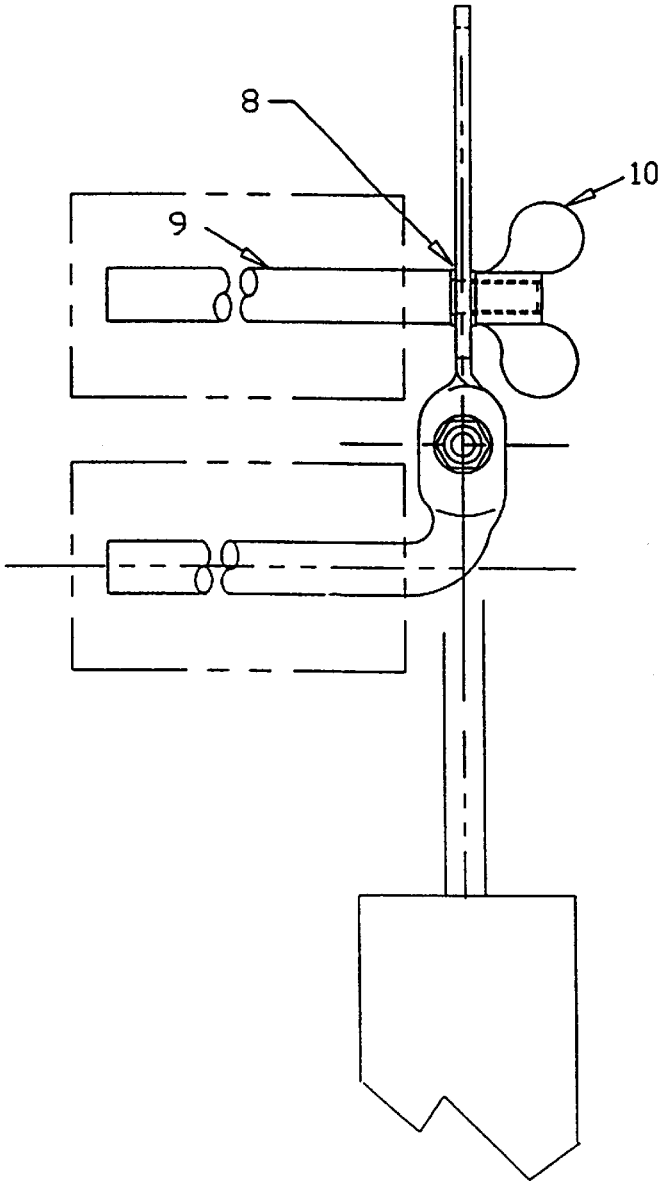
FIG. 2A depicts a front view of a paint frame according to a second preferred embodiment of the invention.
Figure 2B:
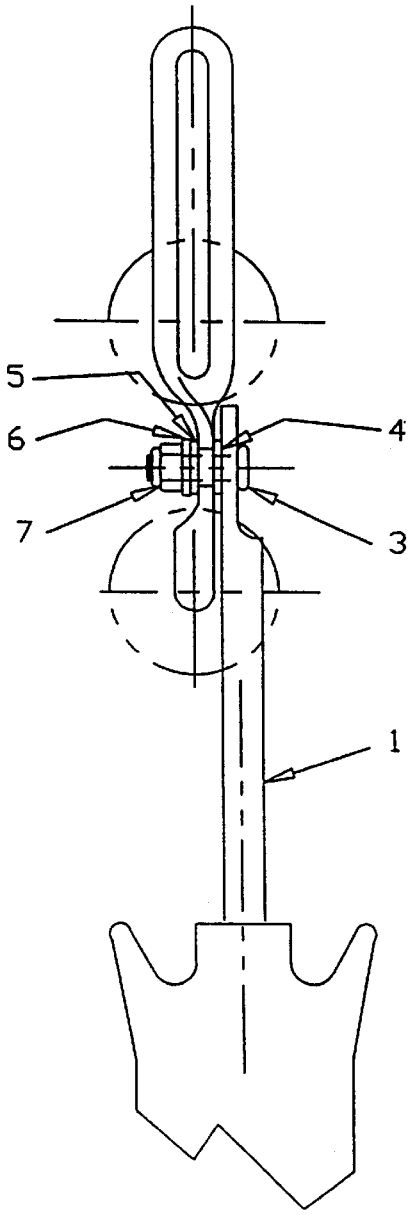
FIG. 2B depicts a side view of the paint frame shown in FIG. 2A.

A second embodiment of a paint frame according to the invention is shown in FIGS. 2A and 2B. The paint frame includes a pivotal mechanism located where the flattened end of the paint frame handle and shaft portion 1, the flattened shaft end having a hole through the center, intersects with the flattened center of the "L" shaped frame portion slotted 8 which also has a hole through its center and is one of two pieces forming the "U" shaped frame portion. The second piece is a straight rod piece 9 with a threaded end which can be positioned anywhere within the flattened slotted area of the "L" shaped piece 8. The straight rod piece 9 is secured in-place by wing nut 10. Roller covers are installed over the ends of this two piece "U" shaped frame portion.

The second embodiment shown in FIGS. 2A and 2E differs from the embodiment depicted in FIGS. 1A and 1B in that two pieces 8 and 9 make up the "U" shaped frame portion. These pieces can be adjusted closer together or farther apart thereby making the frame adjustable as well as pivotal As shown in FIGS. 2A and 2B, the paint frame of the second embodiment includes a frame handle and shaft 1, a nylon washer 4 inserted over the protruding threaded end of stud 3 that has been installed through the flattened shaft end of the frame handle and shaft 1, the "L" shaped frame portion slotted 8 with a hole in its center, another nylon washer 5 and a metal washer 6 all are placed over the protruding threaded end of the stud 3. Lock nut 7 then caps the remaining protruding threaded end of the stud 3. The lock nut 7 not only secures the components forming the pivot mechanism, but it also applies and secures the friction tension on the frame portions 1 and 8. The straight rod piece 9 is placed through the slotted section of the "L" shaped piece 8. Wing nut 10 is installed on the protruding threaded end of the straight rod piece 9 and tightened down securing it firmly to the "L" shaped piece 8.

Figure 3A:
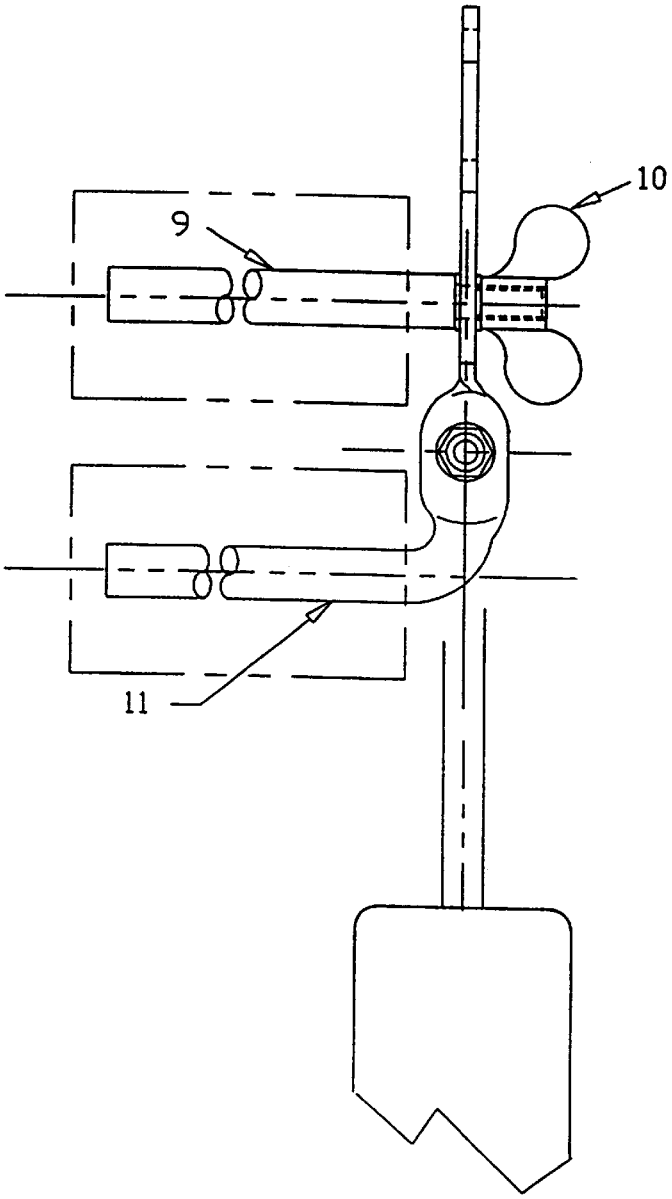
FIG. 3A depicts a front view of a paint frame according to a third preferred embodiment of the invention.
Figure 3B:
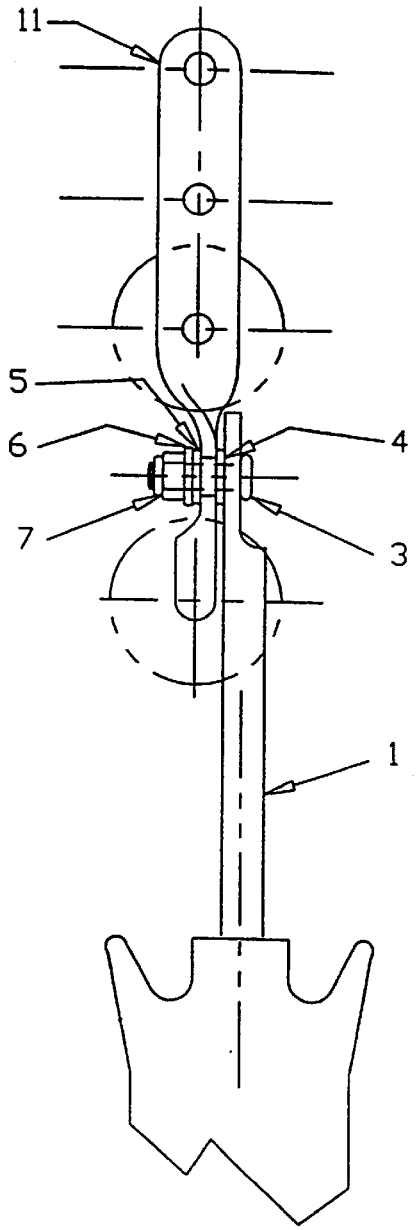
FIG. 3B depicts a side view of the paint frame shown in FIG. 3A.

A third embodiment of the invention is shown in FIGS. 3A and 3B. The third embodiment is configured similar to the embodiment shown in FIGS. 2A and 2B except that the flattened end of the "L" shaped frame portion 11 has three holes in it to accept the installation of the straight rod piece 9. Roller covers are installed over the ends of this two piece "U" shaped frame portion. This differs from the first two embodiments in that the two pieces 9 and 11 making up the "U" shaped frame portion can be adjusted to one of three fixed widths. The pivotal mechanism is the same as that for the first two embodiments.

In more detail, the paint frame shown in FIGS. 3A and 3B includes a frame handle and shaft 1, a nylon washer 4 inserted over the protruding threaded end of stud 3 that has been installed through the protruding end of the stud 3 in the order noted, all of which are secured together by a lock nut 7. The lock nut 7 not only secures the components forming the pivoting mechanism, but it also applies and secures the friction tension on both frame portions 9 and 11. The threaded end of the straight rod piece 9 can be inserted through any one of the three holes in the flattened end of the "L" shaped piece 11 and secured by a wing nut 10.

Figure 4A:
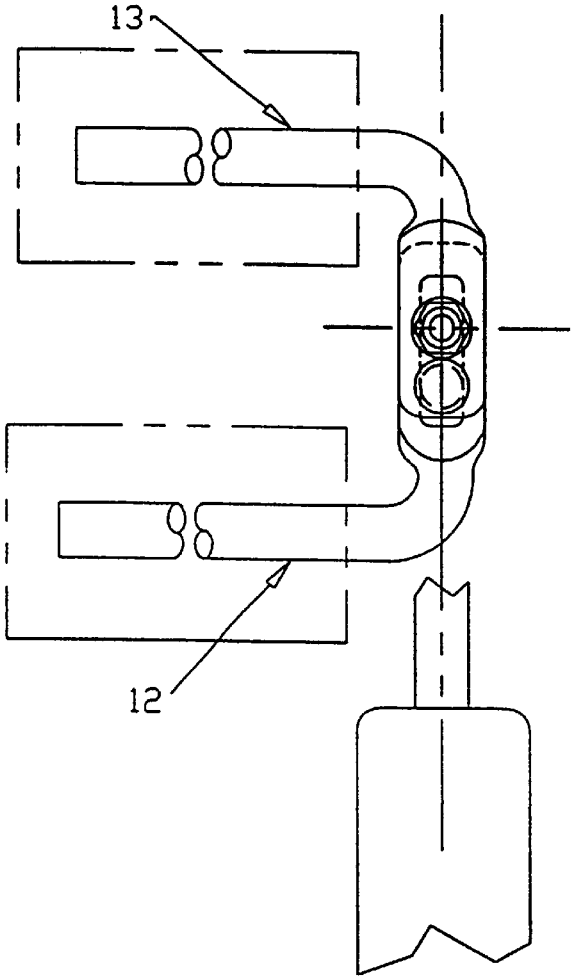
FIG. 4A depicts a front view of a paint frame according to a fourth preferred embodiment of the invention.
Figure 4B:
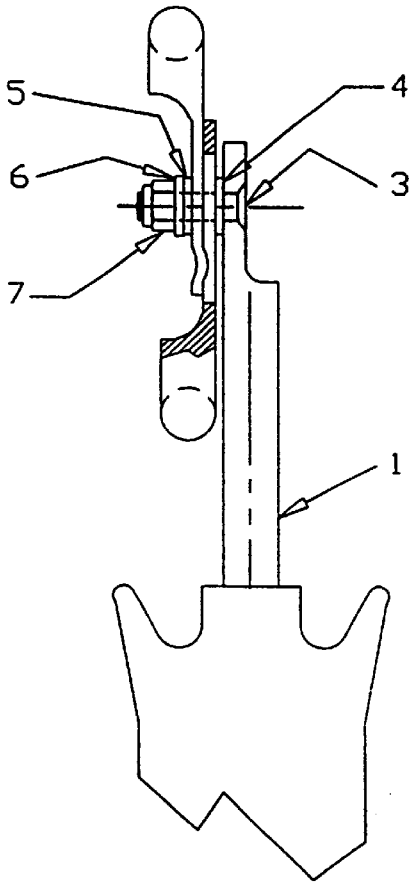
FIG. 4B depicts a side view of the paint frame shown in FIG. 4.

A fourth embodiment of the invention is shown in FIGS. 4A and 4B. It differs from the other embodiments in that this embodiment includes a frame handle and shaft 1, a nylon washer 4 inserted over the protruding threaded stud 3 that has been installed through the flattened end of the frame handle and shaft 1, two "L" shaped pieces 12 and 13 slotted with flattened ends at one end of each piece, one "L" shaped piece 13 having a dimple near the flattened end. Nylon washer 5 and a metal washer 6 are placed over the stud 3 on top of the "L" shaped pieces 12 and 13 in the order noted. All pieces are secured together by a lock nut 7. The lock nut 7 not only secures these components together forming the pivoting mechanism but it also applies and secures the friction tension on all frame pieces as described previously herein.

In more detail, FIGS. 4A and 4B show the pivotal mechanism located where the flattened end of the paint frame handle and shaft portion 1, the flattened shaft end having a hole through the center, intersects with the flattened center of the "U" shaped frame portion. The "U" shaped frame portion includes two "L" shaped pieces of equal size and shape, except one piece is slightly different than the other. One of these two pieces is referred to as an "L" shaped piece with flattened end slotted 12 and the other is referred to as an "L" shaped piece with flattened end slotted and dimpled 13. The dimple is near the end of the flattened slotted area. This dimple fits inside the flattened slotted area of the piece 12 and keeps the two pieces 12 and 13 aligned with each other. The slot in the flattened ends allows the pieces to be moved anywhere within the length of the slots which establishes the distance between the two ends of the "U" shaped frame portion upon which roller covers are placed.

In the various embodiments, the preferred materials for use in the adjusting mechanism are a threaded stud 3, two nylon washers 4 and 5, a steel washer 6 and a lock nut 7. These components that comprise the pivot are in common and standard use throughout the industry.

The lock nut 7 can be tightening or loosening with standard type wrenches or pliers to vary the degree of tension applied to the flattened friction surfaces of the frame shaft handle 1 and any of the four different embodiments of the "U" shaped frame portion. Once the tension is set by tightening the lock nut 7, it will remain at that tension and tightness even after repeated pivoting of the joint.

The frame handle and shaft 1 can be pivoted to a ninety degree angle in either direction with respect to the "U" shaped frame portion (any of the four embodiments discussed above).

The invention shown and described herein reflects the most practical and preferred embodiments. It is recognized that departures may be made from within the scope of the invention, which is, therefore, not to be limited to the details disclosed herein, but is to be afforded the full scope of the claims so as to embrace any and all equivalent apparatus and articles.

What is claimed is:

1. A paint roller frame comprising:

a frame handle and shaft, the frame handle and shaft having two ends, one of the ends having a handle and the other end having a flattened end;

a threaded stud disposed through a hole in the flattened end of the frame handle and shaft;

a "U" shaped frame having parallel ends which hold roller covers, the "U" shaped frame comprising a single piece with a portion near its center that is flattened with a hole defined there through for fitting over the threaded stud protruding from the frame handle and shaft or dual pieces wherein each dual piece has an end forming one of the parallel ends and another end that is flattened with a hole defined there through for fitting over the threaded stud protruding from the frame handle and shaft;

a nylon washer placed over the threaded stud and being positioned between the frame handle and shaft and the "U" shaped frame;

a nylon washer and a metal washer placed over the threaded stud on top of the "U" shaped frame; and a lock nut capping the threaded stud to secure the "U" shaped frame and washers to the frame handle and shaft together, wherein the threaded stud, nylon washers, metal washer and lock nut define a pivotal mechanism whereby the frame handle and shaft can be pivoted at an angle of choice with respect to the "U" shaped frame.

2. A paint roller frame of claim 1 that holds two roller covers on the "U" shaped frame parallel to each other thereby allowing the user to apply protective or decorative coating material to two opposite sides of an item at the same time.

3. A paint roller frame of claim 1 wherein the nylon washer positioned between the frame handle and shaft and "U" shaped frame enables their respective flattened areas to move smoothly over the surface of the nylon washer for pivotal movement.

4. A paint roller frame of claim 1 wherein the lock nut can be torqued to set the tension on the frame handle and shaft and the "U" shaped frame sufficient to hold the frame handle and shaft and the "U" shaped frame firmly in-place at an angle of choice.

5. A paint roller frame of claim 1 wherein the pivotal mechanism permits movement of the "U" shaped frame up to a ninety degree angle in either direction to the frame handle and shaft.

6. A paint roller frame of claim 1 wherein the pivot mechanism allows easy rotation of the frame handle and shaft by hand or by applying pressure to the frame handle and shaft while the roller covers are engaged with the item or structure being protected or decorated.

7. A paint roller frame of claim 1 wherein the dual pieces forming the "U" shaped frame can be adjusted so that the parallel ends can be moved closer together or farther apart to accommodate the item being protected or decorated.

8. A paint roller frame comprising:

a frame shaft having two ends, one of the ends having a flattened end;

a frame comprising two or more substantially parallel roller shafts, wherein the roller shafts hold roller covers; and a pivot joint connecting the frame to the frame shaft wherein the pivot allows the frame shaft to be pivoted to form an angle of choice between the frame shaft and the roller shafts.

9. The paint roller frame of claim 8 wherein the pivot joint comprises one or more plastic layers interposed between the frame shaft and the frame.

10. The paint roller frame of claim 8 wherein the pivot joint comprises one or more nylon layers interposed between the frame shaft and the frame.

11. The paint roller frame of claim 8 wherein the frame is a unitary piece and is "U" shaped.

12. The paint roller frame of claim 8 wherein the frame is "U" shaped and wherein the frame comprises at least two separate roller shafts.

13. A paint roller frame of claim 12 wherein the roller shafts of the frame can be adjusted so that the substantially parallel ends can be moved closer together or farther apart to accommodate an item being protected or decorated.

14. A paint roller frame of claim 8 that holds two roller covers on the frame shafts thereby allowing the user to apply protective or decorative coating material to two opposite sides of an item at the same time.

15. A paint roller frame of claim 8 wherein the pivot joint allows the frame and frame shaft to move smoothly for pivotal movement.

16. A paint roller frame of claim 8 wherein the pivot joint comprises a fastener that applies allows a tension to be set for application to the frame shaft and the frame sufficient to hold the frame shaft and the frame firmly in place at an angle of choice.

17. A paint roller frame of claim 8 wherein the pivot joint permits movement of the frame up to a ninety degree angle in either direction to the frame shaft.

18. A paint roller frame of claim 8 wherein the pivot joint allows easy rotation of the frame shaft by hand or by applying pressure to the frame shaft while the roller covers are engaged with an item or structure being protected or decorated.

* * * * *

UNITED STATES PATENT AND TRADEMARK OFFICE

CERTIFICATE OF CORRECTION

PATENT NO. : 6,219,877 B1
DATED : April 24, 2001
INVENTOR(S) : Roland E. Lowrey and James M. Guest It is certified that error appears in the above-identified patent and that said Letters Patent is hereby corrected as shown below:

Column 5,
Lines 17 and 21, replace “there through” with -- therethrough -- (both occurrences).
Line 49, replace “in-place” with -- in place --.

Column 6,
Line 43, after “that” delete “applies --.

Signed and Sealed this

Third Day of September, 2002

*Attest:*

*Attesting Officer*

JAMES E. ROGAN
*Director of the United States Patent and Trademark Office*